United States Patent [19]

Butler et al.

[11] Patent Number: 5,002,284

[45] Date of Patent: Mar. 26, 1991

[54] BALLOON BOUNCE GAME

[76] Inventors: Richard P. Butler; James P. Butler, both of R.D. 1, Box 655, Gardiner, N.Y. 12525

[21] Appl. No.: 586,696

[22] Filed: Sep. 24, 1990

[51] Int. Cl.[5] ..... A63B 67/00

[52] U.S. Cl. ..... 273/342; 273/409; 273/411

[58] Field of Search ..... 273/342, 411, 409

[56] References Cited

U.S. PATENT DOCUMENTS

| | | | |
|---|---|---|---|
| 1,556,046 | 10/1925 | Taylor | 273/411 |
| 2,051,476 | 8/1936 | Grant | 273/342 |
| 2,163,456 | 6/1939 | Youngberg | 273/342 |
| 2,822,176 | 2/1958 | Robes | 273/411 X |
| 3,107,095 | 10/1963 | Cairns | 273/428 X |
| 3,176,990 | 4/1965 | Aliff | 273/428 |
| 3,580,578 | 5/1971 | McCarthy | 273/401 X |
| 4,354,685 | 10/1982 | Hampson | 273/342 |
| 4,355,813 | 10/1982 | Rathjen | 273/411 |
| 4,426,080 | 1/1984 | Stokes | 273/118 R |
| 4,523,762 | 6/1985 | Garner, Sr. | 273/411 |
| 4,538,817 | 9/1985 | Ramella | 273/380 |
| 4,556,218 | 12/1985 | Barron | 273/411 |
| 4,834,392 | 5/1989 | Nixon | 273/411 |
| 4,880,243 | 11/1989 | Raub | 273/411 |

*Primary Examiner*—William H. Grieb

*Attorney, Agent, or Firm*—Leo Zucker

[57] ABSTRACT

A balloon bounce game suitable for use indoors, includes a generally rectangular mat of flexible material for defining a playing surface, the mat having first indicia for defining a center line that divides the playing surface into two equal area play fields, and second indicia for defining score areas in each of the play fields. The mat is of such dimensions as to enable the mat to be placed on a floor indoors, and for a player located in a serve zone behind a far end of one of the play fields to hit or strike a balloon over the center line to bounce or land in a score field in the other one of the play fields. The form and positions of the indicia therefore make a vertical net unnecessary.

10 Claims, 2 Drawing Sheets

BALLOON BOUNCE GAME

BACKGROUND OF THE INVENTION

1. Field of the Invention

The present invention relates generally to games suitable for play indoors, and more particularly to a game in which a floor mat with specific marking indicia is provided for defining score zones in connection with the serving, hitting or striking of a balloon between players standing behind the far ends of the mat.

2. Description of the Known Art

U.S. Pat. No. 3,176,990 issued Apr. 6, 1965, discloses a game including a target sheet which is spread out on a flat surface such as a floor. The sheet is divided into a number of squares representing scoring areas each having a number marked therein together with a mathematical sign. A separate cubical scoring marker is provided with numbers on its sides, and a player cocks the scoring marker under his/her shoe causing it to be propelled onto one of the scoring areas on the sheet. A score is computed by using the number facing up on the marker in a computation that is printed in the landed scoring area.

U.S. Pat. No. 2,822,176 issued Feb. 4, 1958, discloses a playing court for an aerial disk game. The court is bisected by a center line, and rectangular serving areas are defined at opposite ends of the court by respective serve lines. The size of the court is specified as about 40 feet by 8 feet.

As far is known, no game has been proposed for use indoors in which a specially marked floor mat can be used for purposes of game scoring, and wherein a conventional rubber balloon is served, hit or struck between two players standing behind the far ends of the mat who try to bounce the balloon in marked score areas of the mat.

SUMMARY OF THE INVENTION

An object of the invention is to provide a game suitable for play indoors and which nonetheless affords the players an opportunity to test their relative levels of agility.

Another object of the invention is to provide an athletic type game suitable for play indoors without risk of breakage of any furniture or other surrounding objects during the play.

Another object of the invention is to provide a game for use indoors in which a relatively harmless object such as an inflated balloon is bounced off of designated areas on a floor mat for purposes of scoring.

According to the invention, a balloon bounce game suitable for use indoors, includes a generally rectangular mat of flexible material for defining a playing surface, the mat having first indicia means for defining a center line that divides the playing surface into two equal area play fields, and second indicia means for defining score areas in each of the play fields. The mat is of such dimensions as to enable the mat to be placed on a floor indoors, and for a player located in a serve zone behind a far end of one of the play fields to hit or strike a balloon over the center line to bounce or land in a score field in the other one of the play fields.

For a better understanding of the present invention, together with other and further objects, reference is made to the following description taken in conjunction with the accompanying drawing, and the scope of the invention will be pointed out in the appended claims.

DETAILED DESCRIPTION OF THE INVENTION

Figure 1:
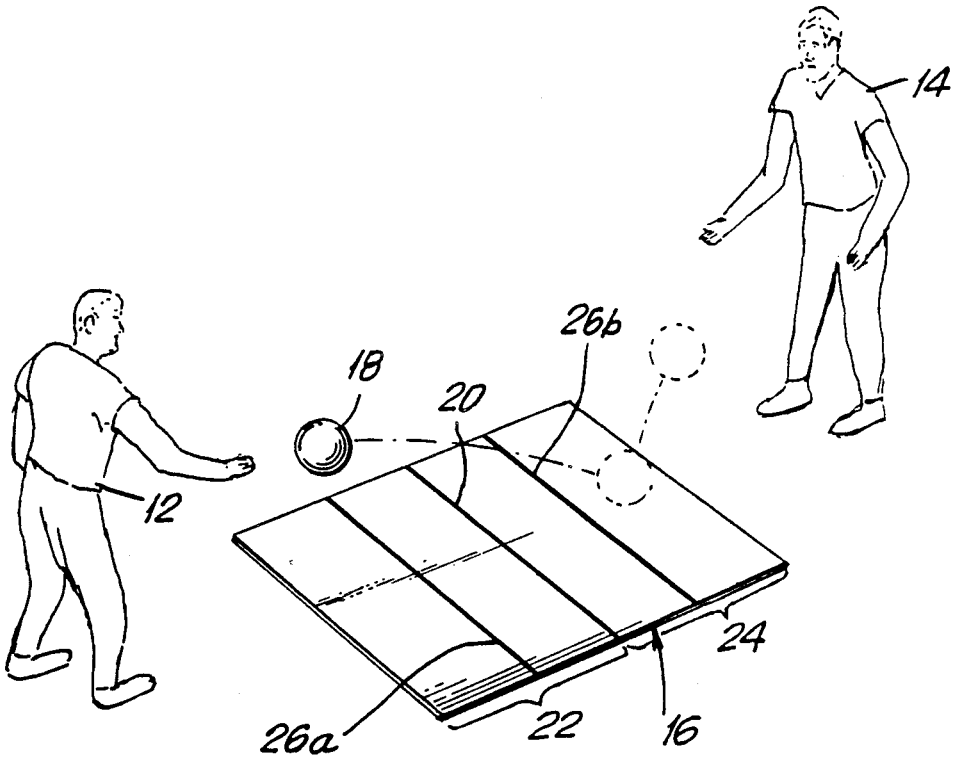
FIG. 1 is a perspective view of two players engaged in a balloon bounce game according to the invention.

FIG. 1 shows two players 12, 14 engaged in a balloon bounce game according to the invention.

The present game is played with a floor mat 16 on which certain marking indicia is provided to enable scoring of the game.

Mat 16 is generally rectangular and can be made of flexible plastics or cloth material. The game is played with an inflatable balloon 18, which when inflated measures between about 10–11 inches in diameter.

Typical dimensions for the mat 16 when laid out on a floor are, for example, 77 inches in length by 54 inches width.

Figure 2:
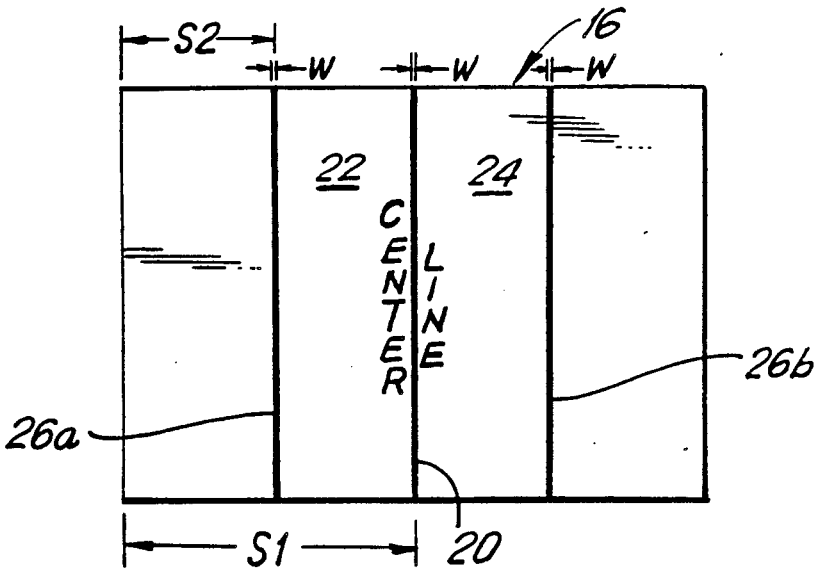
FIG. 2 is plan view of a first embodiment of a playing surface mat according to the invention.

FIG. 2 is a plan view of the first embodiment of the game playing surface mat 16 as shown in FIG. 1 with marking indicia thereon. Depending on the material of the mat 16, the various marking indicia disclosed herein can be sewn, adhered, painted or otherwise impregnated in the material.

First indicia 20 defines a center line that divides the playing surface into two equal area play fields 22, 24. Second indicia **26*a*, 26*b* which are in the form of straight lines in the embodiment of FIGS. 1 and 2, define score areas in each of the play fields 22, 24 as explained in FIG. 3. Indicia 20 in combination with indicia 26*a* or 26*b* therefore function in lieu of a vertical net. That is, it is necessary for a player playing on one of the play fields to serve or hit the balloon 18 over and above the first indicia 20, so that the balloon will land in a score area defined by second indicia 26*a* or 26*b*** in the opposite play field.

Figure 3:
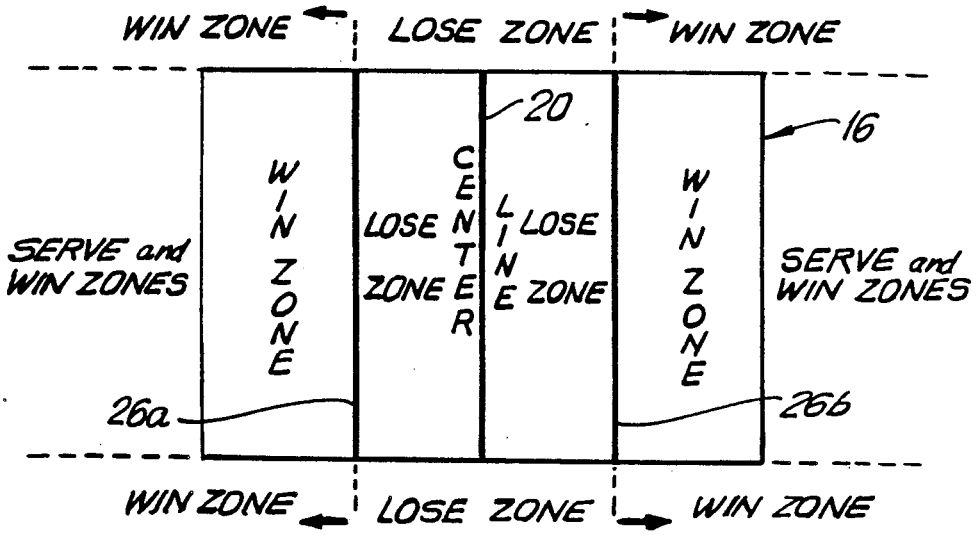
FIG. 3 is a view for explaining scoring when using the mat of FIG. 2.

It is noted that the legends appearing on the surface of the mat 16 in FIGS. 2 and 3 are for purposes of explanation only, and are preferably omitted from the playing surface of the mat 16 as shown in FIG. 1. In the preferred embodiment, the width W of the first indicia 20 and of the second indicia **26*a*, 26*b* is about 1 inch. Each play field 22, 24 extends a distance S1 of 38 ½ inches from the center line indicia 20, and each of the second indicia 26*a*, 26*b* are aligned a distance S2 of 20 inches from the far ends of the play fields 22, 24**.

The following general instructions apply prior to commencement of the present balloon bounce game.

General Instructions

Step 1: Inflate the balloon to approximately 10–11 inches in diameter.

Step 2: Tuck the knotted end into the balloon and secure it in place with a piece of tape to create a smooth surface.

Step 3: Clear away furniture and any other obstacles, and then spread the playing surface on the floor in the open area.

The following game—"Game A"— may now be played with the first embodiment of the mat 16 as shown in FIGS. 1–3.

GAME A

Objective: The first player to score 20 points wins the game.

Rules of Play

1. Serving: To begin play, player 1 serves the balloon from his/her serve zone which extends beyond each far end of the mat (FIG. 3). The balloon must be served with an upward motion as it travels over the length of the playing surface. If the balloon crosses the sidelines of the playing surface during the serve, player 2 wins the point. If the serve fails to cross the opponent's score line 26*a* or 26*b*, or if it is not served with an upward motion, player 2 wins the point. Service continues until player 1 wins a point. Player 2 then takes over as the server. (The player who loses the previous point always serves).

2. Scoring: The receiving player returns the serve, making sure that the balloon crosses the opponent's score line. Points are scored by bouncing the balloon on the playing surface (or floor) in the opponent's score area or "Win Zone" (see FIG. 3). Conversely, the opponent wins the point if the shot bounces short of the score line into a "Lose Zone". The players change ends when the leader's score reaches 10 points.

3. Out-of-Bounds: Shots that cross the opponent's score line and which are off the playing surface count. A player cannot, however, hit two shots in a row off the playing surface on the same side.

4. Hitting the Balloon: The first four shots (including the serve) that cross the center line must be hit with an upward motion. After the fourth shot, the balloon may be hit in any fashion. A player can hit the balloon twice before returning it to the opponent. In other words, a player can use the first hit to set up the return shot. The balloon can be hit with any part of the body. Contact with the balloon by any part of the body counts as one hit, however.

5. The Playing Surface: If a player touches the playing surface during play, the opponent wins the point. If any part of a player's body crosses the center line, the opponent wins the point.

6. Caroms: A player can hit the balloon off any surface or object in the immediate area without penalty.

Figure 4:
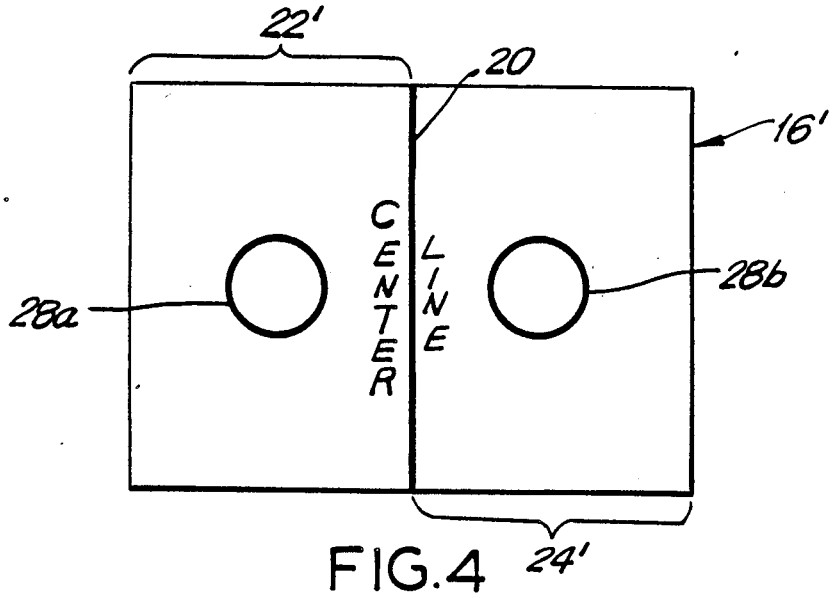
FIG. 4 is plan view of a second embodiment of a playing surface mat according to the invention.

FIG. 4 is a plan view of a second embodiment of a floor mat 16' according to the invention. The mat 16' has the first indicia 20 defining the center line which divides the playing surface of the mat 16' into two equal area play fields 22', 24'. Second indicia 28*a*, 28*b* are provided in the form of closed score areas in each of the play fields 22', 24'. The second indicia 28*a*, 28*b* preferably form circular target areas the centers of which are located 20 inches from the end borders of the play fields 22', 24'.

After following the general instructions set out above with respect to preparation of the balloon 18, and spreading of the mat 16' on the floor in an open area, a second game—"Game B"—may now be played with the floor mat 16' according to the invention.

GAME B

Objective: The first player to score 20 points wins the game.

Rules of Play

1. Serving: Player 1 places the balloon in play by hitting it over the playing surface, across the center-line and the opponent's back or end line. Player 2 must return the balloon in such a fashion that it crosses the center-line and some portion of the opponent's play field 22' or 24'. Player 1 continues to serve until player 1 wins a point, at which time player 2 becomes the server.

2. Scoring: If a player bounces the balloon on any portion of the opponent's target area 28*a* or 28*b*, that player wins three points. If the player fails to hit the target area, and the balloon bounces on any other portion of the playing surface, the opponent wins one point. If a player fails to return the balloon across the center-line and some portion of the opponent's play field, the opponent wins the point. If the server fails to hit the balloon over the playing surface, across the center line and the opponent's end line, the opponent wins the point. If a player fails to return a shot which has crossed the center-line and some portion of that player's play field, and it bounces off the playing surface, the opponent wins the point. Players change ends as soon as one player scores 10 points.

3. Out-of-Bounds: Shots that cross the center-line and some portion of the opponent's play field, count. If a shot fails to cross some portion of the opponent's play field, the opponent wins the point.

4. Hitting the Balloon: A player can hit the balloon twice before returning it to the opponent. In other words, a player can use the first hit to set up the return shot. The balloon can be hit with any part of the body. Contact with the balloon by any part of the body counts as one hit, however.

5. The Playing Surface: If a player touches the playing surface during play, the opponent wins the point. If any part of a player's body crosses the center line, the opponent wins the point.

6. Caroms: A player can hit the balloon off any surface or object in the immediate area without penalty.

It will be appreciated that the first and second embodiments of the mats 16, 16' can be realized from a single flexible mat on which the indicia 20, 26*a*, 26*b* are printed on one major side, and the indicia 20, 28*a*, 28*b* are printed on the reverse major side of the mat. Accordingly, either one of the games—"Game A" or "Game B" may be played as desired depending on the side of the mat which faces up from the floor.

Figure 5:
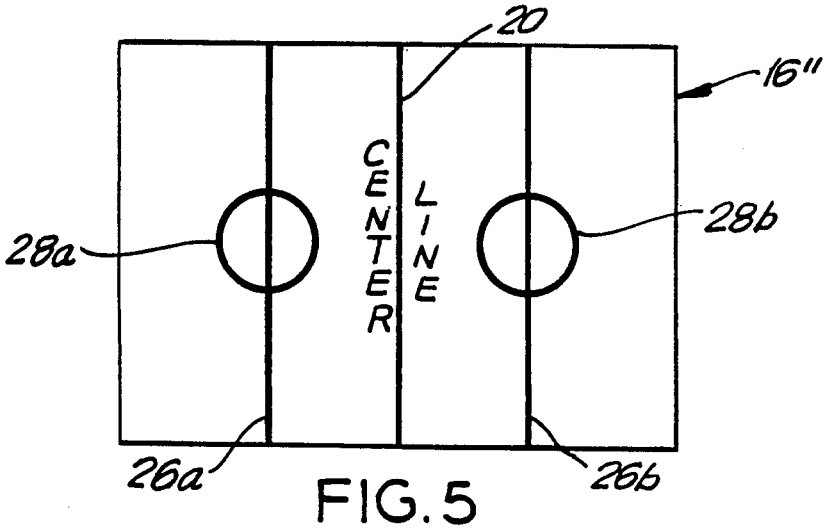
FIG. 5 is a plan view of a third embodiment of a playing surface mat according to the invention.

FIG. 5 is a plan view of a third embodiment of a floor mat 16'' according to the invention wherein all of the indicia 20, 26*a*, 26*b* and 28*a*, 28*b* are combined to appear on one major side of the mat 16''. In the embodiment of FIG. 5, the diameters of the circular target areas formed by second indicia 28*a*, 28*b* are aligned with the straight line indicia 26*a*, 26*b*. The players may then switch between "Game A" and "Game B" without having to turn the mat 16'' over on the floor.

While the foregoing description represents preferred embodiments of the invention, it will be obvious to those skilled in the art that various changes and modifications may be made without departing from the true spirit and scope of the invention as pointed out in the following claims.

What is claimed is:

1. A balloon bounce game suitable for use indoors, comprising:

a generally rectangular mat of flexible material for defining a playing surface, said mat having first indicia means for defining a center line that divides the playing surface into two equal area play fields, and second indicia means for defining score areas in each of said play fields;

wherein said mat is of such dimensions to enable the mat to be placed on a floor indoors, and for a player located in a serve zone behind a far end of one of said play fields to hit an inflated balloon over said center line to bounce or land in a score area defined by said second indicia means in the other one of said play fields.

2. The balloon bounce game of claim 1, wherein said second indicia means forms a straight line in each play field which line is parallel to said center line.

3. The balloon bounce game of claim 1, wherein said second indicia means forms a closed target area in each play field.

4. The balloon bounce game of claim 1, wherein said second indicia means forms a straight line and a closed target area in each play field.

5. The balloon bounce game of claim 4, wherein said closed target area is a circle the diameter of which overlies said straight line.

6. A balloon bounce game suitable for use indoors, comprising:

a mat of flexible material for defining a first playing surface on a first major side of the mat, and a second playing surface on a second major side of the mat opposite said first major side;

first indicia means for defining a center line that divides the first and the second playing surfaces each into two equal area play fields;

second indicia means for defining score areas in the play fields of said first playing surface; and third indicia means for defining score areas in the play fields of said second playing surface;

wherein said mat is of such dimensions to enable the mat to be placed on a floor indoors, and for a player located in a serve zone behind a far end of one of said play fields of either playing surface to hit an inflated balloon over the center line to bounce or land in a defined score area in the other one of said play fields of the playing surface.

7. The balloon bounce game of claim 6, wherein said second indicia means forms a straight line in each play field of the first playing surface, which line is parallel to the center line.

8. The balloon bounce game of claim 6, wherein said third indicia means forms a closed target area in each play field of the second playing surface.

9. The balloon bounce game of claim 1, wherein said first and said second indicia means are arranged to function in lieu of a vertical net.

10. The balloon bounce game of claim 6, wherein said first, second and third indicia means are arranged to function in lieu of a vertical net.

* * * * *